US006069961A

United States Patent [19]

Nakazawa

[11] Patent Number: 6,069,961

[45] Date of Patent: May 30, 2000

[54] MICROPHONE SYSTEM

[75] Inventor: Fumihiko Nakazawa, Kawasaki, Japan

[73] Assignee: Fujitsu Limited, Kawasaki, Japan

[21] Appl. No.: 08/965,191

[22] Filed: Nov. 6, 1997

[30] Foreign Application Priority Data

Nov. 27, 1996 [JP] Japan ..... 8-316567
Jun. 12, 1997 [JP] Japan ..... 9-155246

[51] Int. Cl.[7] ..... H04R 3/00

[52] U.S. Cl. ..... 381/92; 381/122

[58] Field of Search ..... 381/92, 122; 367/124, 367/126

[56] References Cited

U.S. PATENT DOCUMENTS

| | | | |
|---|---|---|---|
| 5,058,170 | 10/1991 | Kanamori et al. | 381/92 |
| 5,193,117 | 3/1993 | Ono et al. | 381/71 |
| 5,226,087 | 7/1993 | Ono et al. | 381/92 |
| 5,524,059 | 6/1996 | Zurcher | 381/92 |
| 5,729,507 | 3/1998 | Massa | 367/124 |

FOREIGN PATENT DOCUMENTS

| | | |
|---|---|---|
| 4-72525 | 3/1992 | Japan . |
| 5-207117 | 8/1993 | Japan . |
| 7-336790 | 12/1995 | Japan . |

*Primary Examiner*—Vivian Chang
*Assistant Examiner*—Debra A. Lemm
*Attorney, Agent, or Firm*—Armstrong, Westerman, Hattori, McLeland & Naughton

[57] ABSTRACT

Provided is a microphone system capable of detecting a direction of a sound source and extracting an object sound with a high S/N ratio. A microphone system comprises a plurality of microphone pairs 1 to 7, each pair having two microphones arranged apart from each other at a predetermined space at a crossing angle of 60 degrees or less, a plurality of subtraction circuits 11*a* for calculating a difference signal of outputs of each microphone pair, a plurality of addition circuits 11*e* for calculating a sum signal of outputs of each microphone pair, circuit sections 11*c*, 11*d* and 20 for detecting, as sound source direction information, a minimum value output from each output of the subtraction circuits 11*a*, and a switch 11*f* for selecting a sum signal of the microphone pairs 1 to 7 corresponding to the minimum value output and for outputting the selected sum signal as sound information.

8 Claims, 10 Drawing Sheets

MICROPHONE SYSTEM

CROSS-REFERENCES TO RELATED APPLICATIONS

This application is related to Japanese Patent Application Nos. Hei 8(1996)-316567 filed on Nov. 27, 1996 and Hei 9(1997)-155246 filed on Jun. 12, 1997 whose priorities are claimed under 35 USC Section 119, the disclosures of which are incorporated herein by reference in their entirety.

BACKGROUND OF THE INVENTION

1. Field of the Invention

The present invention relates to a microphone system to be used for an interface technique of a talker and a personal computer, and more particularly to a microphone system in which a position of a sounder (talker) is input as input data to a personal computer and a signal-to-noise (S/N) ratio of a detecting signal of pronunciation is enhanced so that a sound processing (for example, voice recognition) in a next stage can be improved.

2. Description of the Related Art

Examples of the prior art in which a direction of a sound source is detected by using a plurality of microphones include Japanese Unexamined Patent Publication Nos. HEI 4(1992)-72525, HEI 5(1993)-207117 and HEI 7(1995)-336790.

According to the Japanese Unexamined Patent Publication No. HEI 4(19-72525, a spherical received sound detecting section having an integral structure in which six non-directional microphones are arranged at the space of 90 degrees seen from a center of a sphere on surface thereof is used to detect a received sound pressure level of each microphone and a difference signal of opposite microphones, and to calculate a direction of a sound source based on the received sound pressure level and the difference signal so that the direction of the sound source present in a three-dimensional space can easily be obtained with high precision.

Since only the direction of the sound source is detected by using the six nondirectional microphones, said Publication does not disclose that a S/N ratio is improved to extract an object sound.

According to the Japanese Unexamined Patent Publication No. HEI 5(1993)-207117, a talker's voice, that is, a driver's voice to be input to a mobile phone is received by using at least three microphones for detecting his position, a time difference between voice signals is detected, a position of the talker is detected based on the time difference, and a directional microphone is provided in a direction of the talker so that the influence of noises is reduced to enhance recognition of the talker's voice. In said method, three or more superdirectional microphones are used for extracting an object sound and are provided in a direction of the talker. In general, the superdirectional microphone has a total length of 50 cm or more in order to obtain a high directivity. Furthermore, there is no description on an improvement in the S/N ratio to extract the object sound.

According to the Japanese Unexamined Patent Publication No. HEI 7(1995)-336790, a plurality of microphones are provided to select a microphone in which an output has a maximum value or a generation timing is the earliest so that manual operation of the microphone, an interference of a sound signal and manual operation of mixing can automatically be performed and improved. In said method, a single microphone output is used for extracting a direction of a sound source and an object sound. There is also no description on an improvement in the S/N ratio to extract the object sound.

Therefore, the microphone systems according to the prior arts have problems that a structure is not always small and simple and an object sound in a direction of a sound source cannot be extracted with a high S/N ratio.

SUMMARY OF THE INVENTION

The present invention aims to provide a microphone system having a small and simple structure and capable of detecting a direction of a sound source and extracting an object sound with a high S/N ratio.

In order to attain the above-mentioned object, as shown in FIGS. 3A, 3B and 4, the present invention provides a microphone system comprising: a plurality of microphone pairs, each pair having two microphones arranged apart from each other at a predetermined space at a crossing angle of 60 degrees or less; a plurality of first calculating means for calculating a difference signal of outputs of each microphone pair; a plurality of second calculating means for calculating a sum signal of outputs of each microphone pair; means for detecting, as sound source direction information, a minimum value output from each output of the first calculating means; and means for selecting a sum signal of the microphone pair corresponding to the minimum value output and outputting the selected sum signal as sound information.

DETAILED DESCRIPTION OF THE PREFERRED EMBODIMENT

Figure 3A:
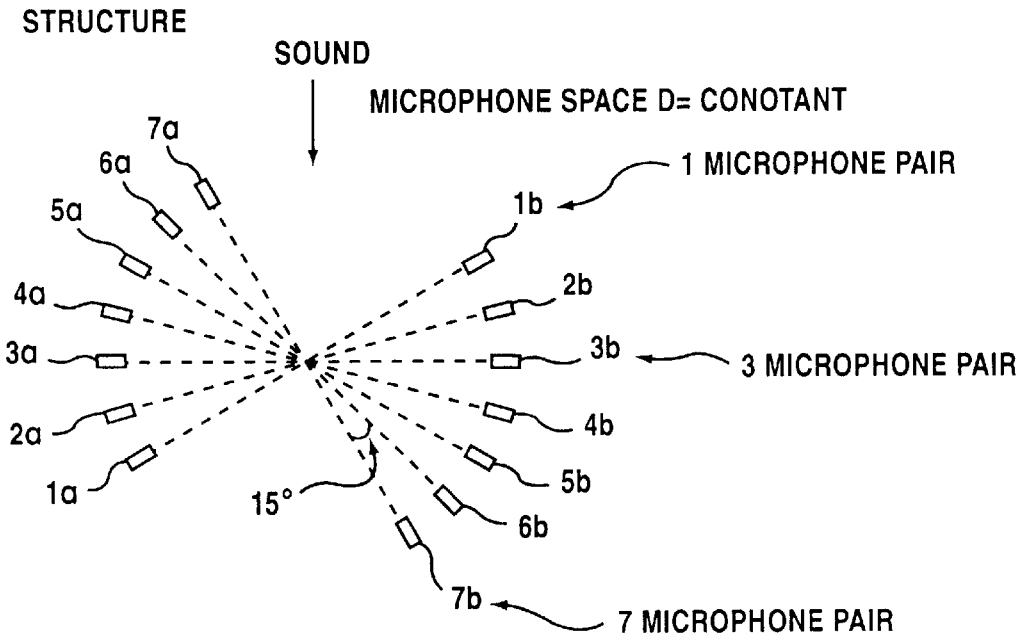
FIGS. 3A and 3B are charts showing a structure and a characteristic of a microphone pair according to a first embodiment of the present invention.
Figure 3B:
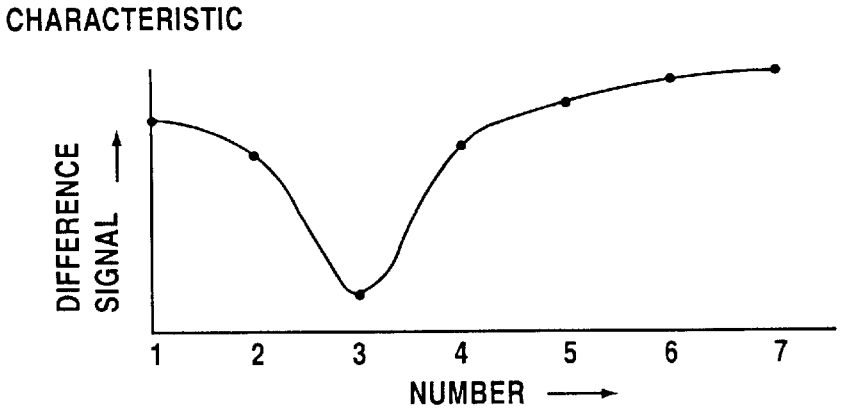
Figure 4:
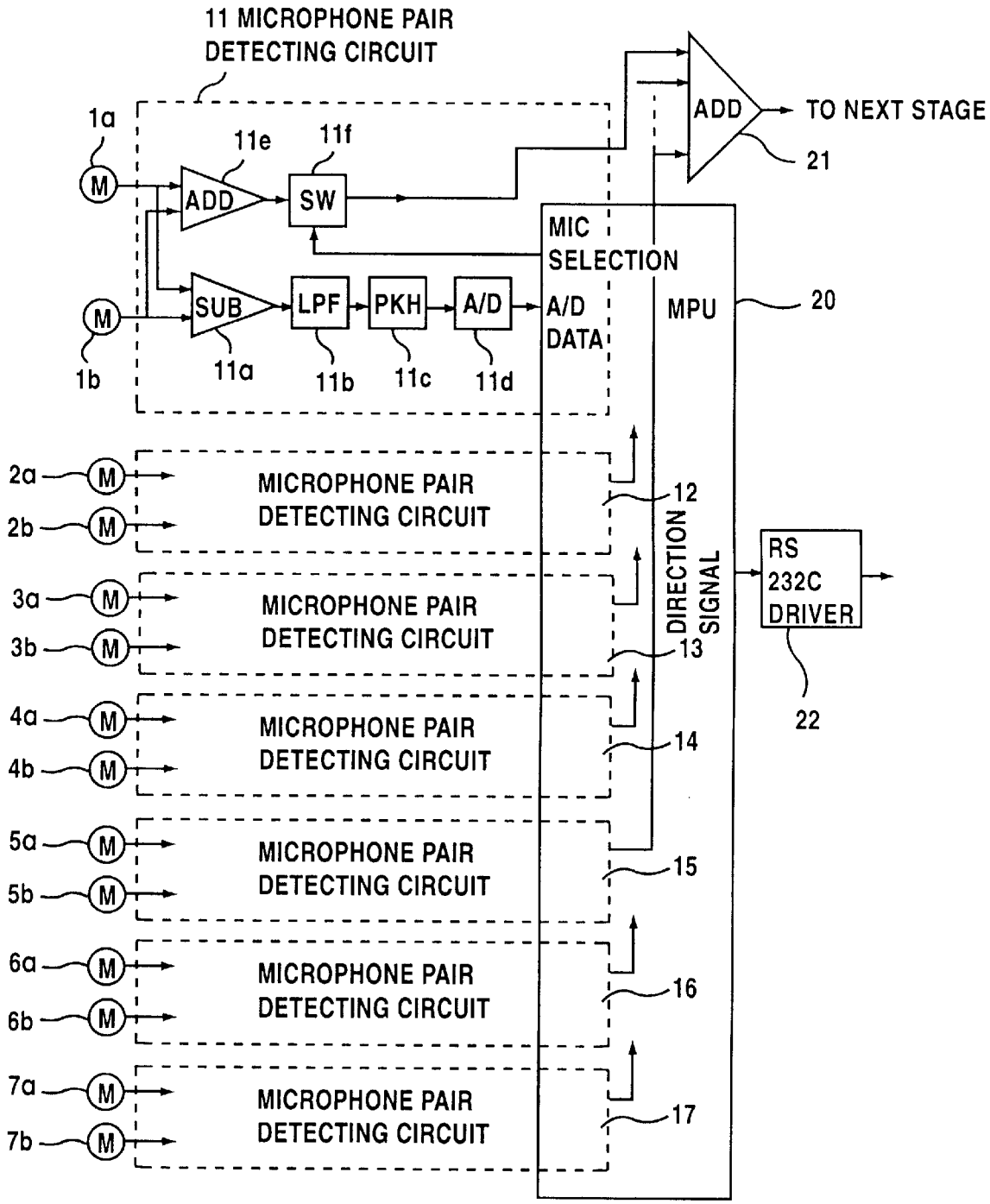
FIG. 4 is a diagram showing a structure of a microphone pair detecting circuit according to an embodiment of the present invention.

Referring to FIGS. 3 and 4, the microphone system of the present invention comprises a plurality of microphone pairs 1 to 7, each pair having two microphones arranged apart from each other at a predetermined space at a crossing angle of 60 degrees or less, a plurality of subtraction circuits 11*a* for calculating a difference signal of outputs of each microphone pair, a plurality of addition circuits 11*e* for calculating a sum signal of outputs of each microphone pair, circuits 11*c*, 11*d* and 20 for detecting, as sound source direction information, a minimum value output from each output of the subtraction circuits 11*a*, and a switch 11*f* for selecting a sum signal of the microphone pair corresponding to the minimum value output and outputting the selected sum signal as sound information.

In the present invention, it is desirable that the switch 11*f* should also select and output a sum signal corresponding to a second smallest difference signal in addition to a sum signal corresponding to a minimum value of a difference signal as shown in FIGS. 3A and 3B and FIG. 4.

As shown in FIGS. 3A and 3B, it is preferable that the plurality of microphone pairs 1 to 7 should be arranged on a concentric circle.

As shown in FIG. 4, it is desirable that the microphone system should further comprises a low-pass filter 11*b* for filtering a difference signal output from a subtraction circuit 11*a* at a cut-off frequency F represented by V/2D=F between a sound velocity V and a space D.

Furthermore, the present invention provides a microphone system comprising a microphone array in which microphone sets are arranged at a crossing angle of 45 degrees or less, each microphone set including a first microphone pair having two microphones arranged apart from each other at a predetermined space and a second microphone pair orthogonal to the first microphone pair, a plurality of first calculating means for calculating a difference signal of outputs of each microphone pair, means for detecting, as a direction of a sound source, a minimum value output from each output of the first calculating means, second calculating means for calculating a ratio of output voltages of a microphone pair orthogonal to a microphone pair corresponding to the minimum value output, and means for calculating a distance from the microphone array to a sound source based on the ratio of the output voltages which is calculated by the second calculating means.

Moreover, the present invention provides a microphone system comprising a plurality of sound source direction discriminators including a plurality of microphone pairs, each pair having two microphones arranged apart from each other at a predetermined space at a crossing angle of 60 degrees or less, a plurality of calculating means for calculating a difference signal of outputs of each microphone pair, and means for detecting, as a direction of a sound source, a minimum value output from each output of the calculating means, wherein a crossing point of the directions of the sound source which are obtained by the sound source direction discriminators is calculated, thereby detecting a position of the sound source.

In the above-mentioned microphone system, it is desirable that a non-directional microphone should be used for the microphone. In this case, it is preferable that a sound source should be provided on a central axis of the microphone array to adjust a sensitivity of each microphone of the microphone array equally.

Preferred embodiments of the present invention will be described below with reference to FIGS. 1A and 1B to FIGS. 5A and 5B.

First of all, basic matters related to the present invention will be described below with reference to FIGS. 1A and 1B and FIGS. 2A and 2B.

Figure 1A:
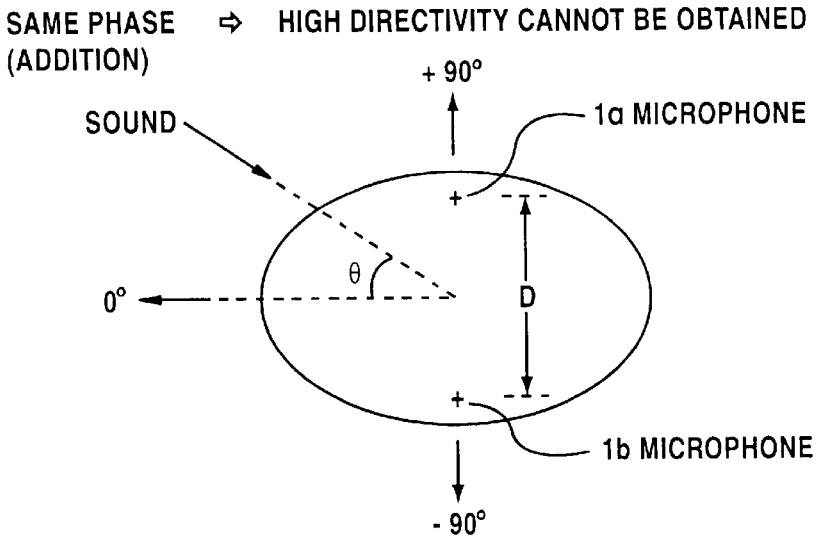
FIGS. 1A and 1B are diagrams showing direction characteristics of a microphone pair having two non-directional microphones.
Figure 1B:
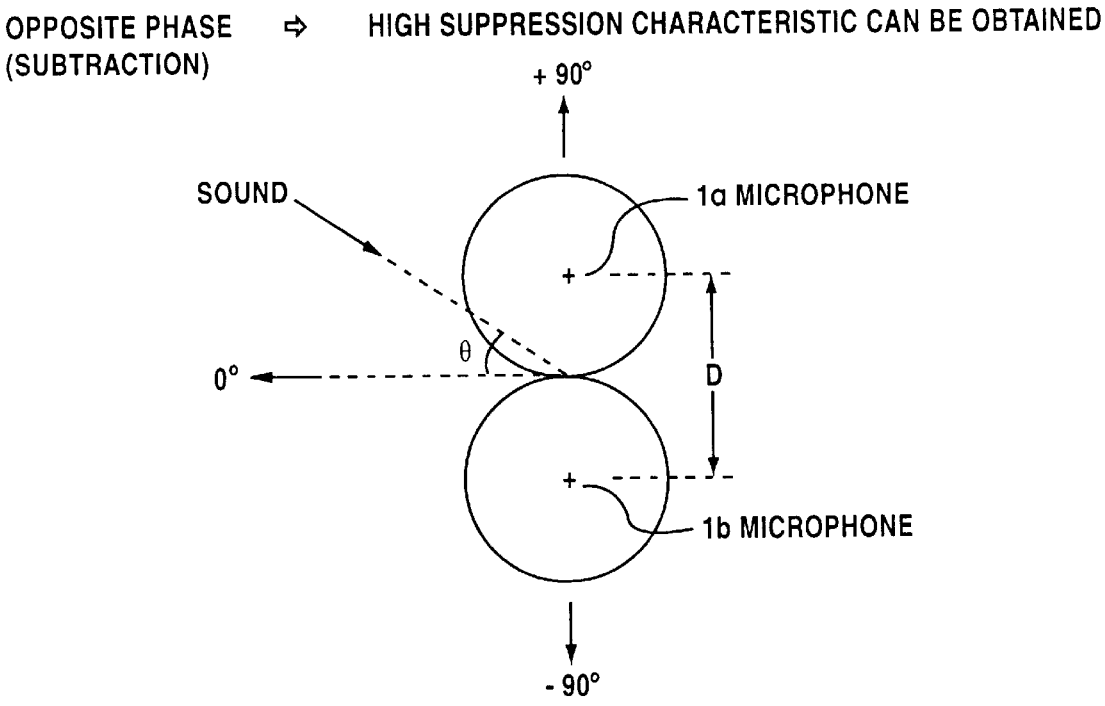

FIGS. 1A and 1B are diagrams showing direction characteristics of a microphone pair having two non-directional microphones. FIG. 1A shows a case in which the two non-directional microphones (hereinafter referred to as microphones) are used in the same phase (addition), and FIG. 1B shows a case in which the microphones are used in opposite phases (subtraction).

The two microphones have the same characteristics (a directivity of a sensitivity and a frequency characteristic), and are provided with a space D.

As shown in FIGS. 1A and 1B, it is assumed that two microphones 1*a* and 1*b* are arranged coaxially to form a microphone pair. If the microphones 1*a* and 1*b* have the same phase (addition) as shown in FIG. 1A, a direction characteristic of a sum signal of the microphones 1*a* and 1*b* in an arrival direction θ of a sound is elliptical.

Accordingly, a great difference is not made between a gain of a direction of 0 degree (a direction perpendicular to directions of arrangement of the microphones 1*a* and 1*b*) and a gain of a direction of 90 degrees (the directions of arrangement of the microphones 1*a* and 1*b*). Consequently, a high direction characteristic cannot be obtained.

However, if the microphones 1*a* and 1*b* have the opposite phases (subtraction) as shown in FIG. 1B, the gain in the direction of 0 degree is suppressed so that a direction characteristic of a difference signal of the microphones 1*a* and 1*b* becomes almost "8" shaped.

Consequently, a great difference is made between the gains in the directions of 0 degree and 90 degrees. Thus, a high direction characteristic can be obtained.

According to the present invention, a direction of a sound source is detected by utilizing a high suppression directivity obtained in case of the opposite phases (subtraction).

Figure 2A:
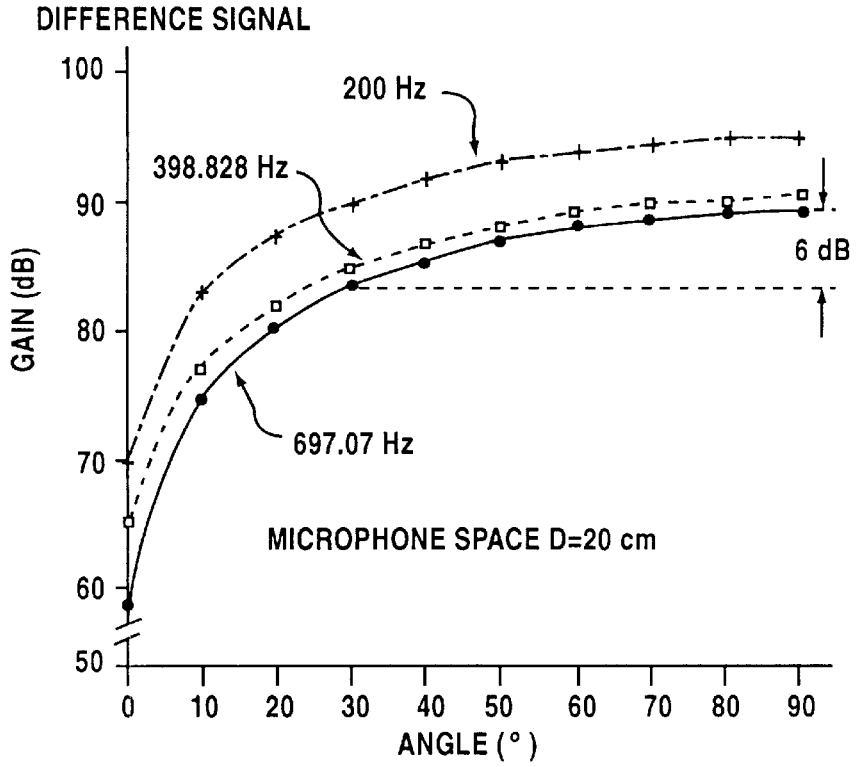
FIGS. 2A and 2B are charts showing characteristics of a difference signal and a sum signal of the microphone pair.
Figure 2B:
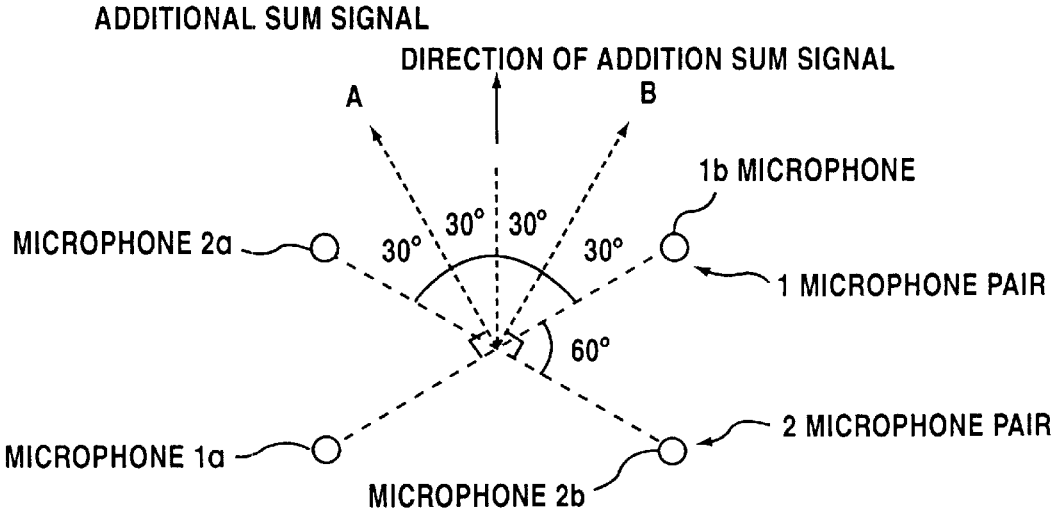

Explanation will be given with reference to FIGS. 2A and 2B. FIGS. 2A and 2B show characteristics of difference and sum signals of the microphone pair.

FIG. 2A shows the difference signal, that is, measured values of direction characteristics (a direction of a sound source and a gain) obtained by using two microphones in opposite phases.

A space D between the microphones is 20 cm, and a frequency of a sound is 200 Hz, 398.828 Hz and 697.07 Hz.

In FIG. 2A, a measuring angle is 90 degrees in a direction of arrangement of the microphone pair. As shown, the gain is the smallest at an angle of 0 degree, and is increased as the angle becomes greater.

Within a range of 0 degree to 30 degrees, the gain is changed by at least 4 dB with an increase in an angle by 10 degrees. However, the gain is changed by about 2 dB or less with the increase in the angle by 10 degrees within a range of 30 degrees or more. In addition, the gain is changed by about 6 dB with the increase in the angle by 10 degrees within a range of 30 degrees to 90 degrees.

More specifically, if a sound arrives in a direction inclined by 30 degrees or more from a front of the microphone pair, the gain is less changed and outputs are rarely changed even if the angle is changed.

Accordingly, in the case where the difference signals of the two microphone pairs whose directions of a sound source are inclined by 30 degrees or more are compared with each other, it is impossible to accurately decide which microphone pair has an inclination closer to the direction of the sound source. In other words, the direction of the sound source cannot be detected accurately.

This indicates that it is necessary to set an angle of the microphone pair in the direction of the sound source to 30 degrees or less at worst. In other words, a crossing angle of two microphone pairs should be set to 60 degrees or less in order to detect an accurate direction of the sound source.

Description will be given with reference to FIG. 2B. FIG. 2B is a chart showing an addition sum signal which is obtained by adding sum signals of the microphone pairs 1 and 2.

It is assumed that the microphones 1*a* and 1*b* have the same phase and that the microphones 2*a* and 2*b* also have the same phase. Accordingly, the microphone pairs 1 and 2 have the same characteristics. A crossing angle of the microphone pairs 1 and 2 is set to 60 degrees.

As shown in FIG. 2B, a direction A of a sum signal of the microphone pair 1 is set to 30 degrees clockwise in a direction of arrangement of the microphone pair 2 which is about twice as much as an output of the microphone 1*a*, for example.

Similarly, a direction B of a sum signal of the microphone pair 2 is set to 30 degrees counterclockwise in a direction of arrangement of the microphone pair 1 which is about twice as much as the output of the microphone 1*a*, for example.

Accordingly, the directions of addition sum signals of the microphone pairs 1 and 2 are set to 30 degrees clockwise in a direction A, and to 30 degrees counterclockwise in a direction B, each of which is about four times as much as the output of the microphone 1*a*, for example.

In general, n signals are synchronously added so that an amplitude becomes n times as much, while n random ambient noises are added so that the amplitude becomes square root times as large as n.

If the microphone pairs 1 and 2 are provided in the direction of the sound source, for example, sounds sent from the sound source are synchronously added. An output of the addition has an amplitude which is a multiple of the number of microphones to be added. The ambient noises are random. Therefore, the amplitude of the ambient noises becomes square root times as large as the number of the microphones to be added.

For example, in the case where a S/N ratio of an output of the microphone 1*a* is compared with that of an output of the microphone pair 1 as described above, S is double at the maximum and N is 1.414 times as much at most. Therefore, the S/N ratio is improved by 3 dB at the maximum which is 1.414 times as much.

Accordingly, the microphone la is improved by 6 dB at the maximum.

Preferred embodiments of the present invention will be described below with reference to FIGS. 3A and 3B to FIGS. 5A and 5B.

Figure 5A:
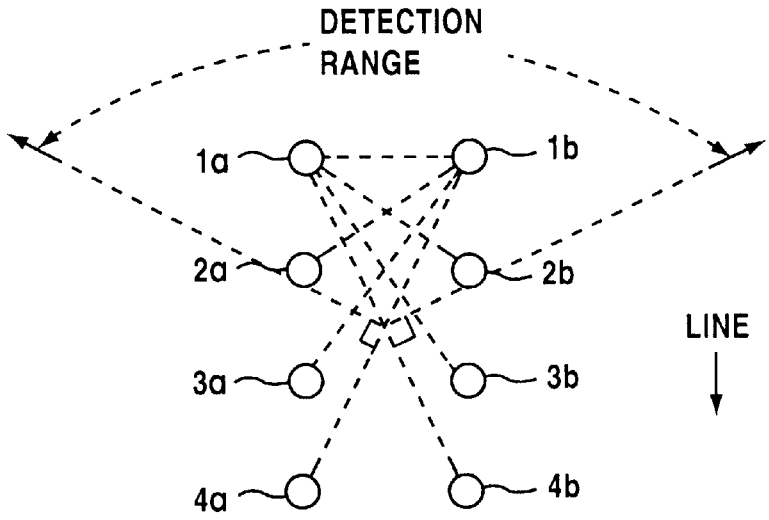
FIGS. 5A and 5B are diagrams showing structures of a microphone pair according to a second embodiment of the present invention.
Figure 5B:
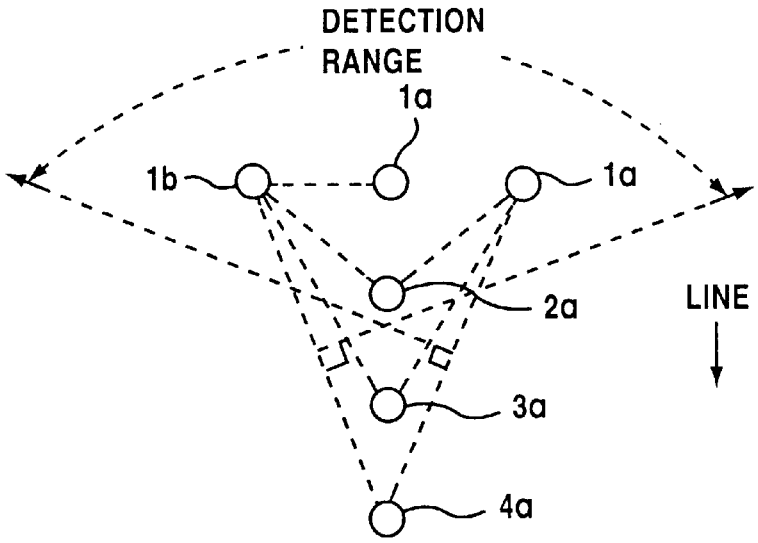

FIGS. 3A and 3B show a structure and a characteristic of a microphone pair according to an embodiment of the present invention. FIG. 3A shows the structure and FIG. 3B shows the characteristic. FIG. 4 is a diagram showing a structure of a microphone pair detecting circuit according to a first embodiment of the present invention, which corresponds to seven microphone pairs 1 to 7 shown in FIG. 3A. FIGS. 5A and 5B shows structures of a microphone pair according to a second embodiment of the present invention.

[First Embodiment]

In FIG. 3A, seven microphone pairs 1 (microphones 1*a* and 1*b*) to 7 (microphones 7*a* and 7*b*) are provided, and a crossing angle of adjacent microphone pairs is set to 15 degrees, for example.

If a sound arrives in a direction of an arrow shown in FIG. 3A, respective levels of difference signals of the microphone pairs 1 to 7 are obtained as shown in a graph of FIG. 3B.

As shown in FIG. 3A, a third microphone pair 3 has a direction of arrangement which is almost perpendicular to a direction of arrival of the sound, and has a level of a difference signal which is the lowest as shown in FIG. 3B.

Furthermore, the level of the difference signal is increased in order of the microphone pairs 2, 4, 1, 5, . . . , 7, for example.

More specifically, the levels of the difference signals of the microphone pairs 1 to 7 are compared with one another. By selecting the microphone pair 3 having the lowest level, the direction of arrival of the sound can be detected.

After the direction of arrival of the sound is detected, an object sound is then detected. By adding sum signals of the microphone pairs whose directions of arrival of the sound have been detected, the object sound is detected.

A subtraction output generated from the difference signal of the microphone pairs is filtered by means of a low-pass filter. A cut-off frequency F of the low-pass filter and a sound velocity V and a space D of the microphone pair have the following relationship.

$$F=V/2D$$

It has been known that arrival of a sound having a higher frequency than the cut-off frequency F causes a dip to be generated on an "8" shaped direction characteristic shown in FIG. 1A so that a directivity loses an "8" shape and an accurate direction of the sound source cannot be detected. For this reason, a frequency component which is higher than the cut-off frequency F is cut by means of the low-pass filter.

A processing of an output signal of the microphone pair will be described below with reference to FIG. 4.

In FIG. 4, 1*a* and 1*b* denote microphones forming the microphone pair 1 shown in FIG. 3A. Similarly, 2*a* and 2*b* to 7*a* and 7*b* denote microphones forming the microphone pairs 2 to 7.

11 to 17 denote microphone pair detecting circuits having the same structure in which outputs of the microphones 1*a* and 1*b* to the microphones 7*a* and 7*b* are input and circuits 11*a* to 11*f* are provided.

11*a* denotes a subtraction circuit (SUB) acting as first calculating means, lle denotes an addition circuit (ADD) acting as second calculating means, 11*b* denotes a low-pass filter (LPF), llc denotes a peak hold circuit (PKH), lid denotes an analog/digital converter (A/D), and 11*f* denotes a switch (SW).

20 denotes a MPU (microprocessor unit) acting as a host unit for performing a signal processing. 21 denotes an addition circuit (ADD) for adding a plurality of input signals. 22 denotes a RS232C driver of a low-speed interface.

Furthermore, the circuits 11*c*, 11*d* and 20 correspond to means for detecting information about a direction of a sound source.

For example, respective outputs of sounds received by the microphones (M) 1*a* and 1*b* are input to the SUB 11*a* for subtracting the outputs and the ADD 11*e* for adding the outputs. The SUB 11*a* and the ADD 11*e* are formed by using an operational amplifier according to the prior art.

A subtraction output sent from the SUB 11*a* (which corresponds to a difference signal) is input to the LPF 11*b* having the cut-off frequency F (F=V/2D). An output of the LPF 11*b* is held at a maximum value by means of the PKH 11*c*.

The maximum value held by the PKH 11*c* is converted into analog/digital conversion data (A/DDATA) by the A/D lid, and is input to the MPU 20.

Similarly, outputs of the microphones 2*a* and 2*b* to the microphones 7*a* and 7*b* are input to the microphone pair detecting circuits 12 to 17 to obtain six A/DDATAs. The A/DDATAs are input to the MPU 20, respectively.

In the MPU 20, values of seven A/DDATAs are judged. Based on a minimum value, a direction signal is generated and is output as the detected direction signal of a sound source through the RS232C driver 22.

Furthermore, the MPU 20 sends an output for MIC selection for selecting an addition output (a sum signal) of A/DDATA having a minimum value and an addition output (a sum signal) corresponding to second and third smallest values . . . of the A/DDATA if necessary on the basis of a result of the judgment of values of the seven A/DDATAs , thereby turning on the SW 11*f*. These sum signals are caused to pass and are added to the ADD 21.

If it is decided that the second and third smallest values of the seven A/DDATAs are equal to each other, the SW 11*f* is controlled to select one of them.

In the ADD 21, the SWs 11*f* are turned on to improve the S/N ratio by using at least one of the sum signals which have passed. Then, the sum signal is sent, to a next stage, as a desired detection signal of the microphone having the improved S/N ratio.

While the number of the microphone pairs that are to be added is generally determined by a frequency of the microphone which is to be detected, an arrangement angle of the microphone pairs and a space between the microphone pairs, detailed description will be omitted.

The S/N ratio is improved by 3 dB by addition of one microphone output. Therefore, a detection signal of the microphone pair which gives a minimum value of a difference signal is improved by 3 dB at the maximum as compared with a detection signal of one microphone.

Accordingly, the S/N ratio can be improved by 6 dB at the maximum by adding the detection signals of the microphone pairs corresponding to the minimum and second smallest values of the difference signal, respectively.

[Second Embodiment]

Description will be given with reference to FIGS. 5A and 5B. FIGS. 5A and 5B show structures of microphone arrangement according to a second embodiment.

In a first example shown in FIG. 5A, eight microphones are arranged in two lines.

The microphone pairs are combined in seven ways, that is, four ways of the microphones 1*a* and 1*b* to the microphones 1*a* and 4*b*, and three ways of the microphones 1*b* and 2*a* to the microphones 1*b* and 4*a*.

By selecting the seven ways of combination, it is possible to detect a direction of a sound source and to improve a S/N ratio of an object sound in the same manner as in the embodiment shown in FIG. 3A. In this case, the number of the required microphones can be reduced to 8, which is smaller than the embodiment shown in FIG. 3A.

The sound source is detected within a range from a direction orthogonal to a direction of arrangement of the microphones 1*b* and 4*a* to a direction orthogonal to a direction of arrangement of the microphones 1*a* and 4*b*.

In a second example shown in FIG. 5B, four microphones 1*a* to 4*a* are arranged in a line, and two microphones 1*b* and 1*c* are arranged on both sides of the microphone 1*a*.

The microphone pairs are combined in seven ways, that is, four ways of the microphones 1*b* and 1*a* to the microphones 1*b* and 4*a*, and three ways of the microphones 1*c* and 2*a* to the microphones 1*c* and 4*a*, for example.

In the same manner as in the first example, the direction of the sound source can be detected and the S/N ratio of the object sound can be improve by selecting the seven ways of combination as in the embodiment shown in FIG. 3A. In this case, the number of the required microphones can be reduced to 6, which is smaller than the embodiment shown in FIG. 3A and the first example.

The sound source is detected within a range from a direction orthogonal to a direction of arrangement of the microphones 1*c* and 4*a* to a direction orthogonal to a direction of arrangement of the microphones 1*b* and 4*a*.

[Third Embodiment]

Figure 6:
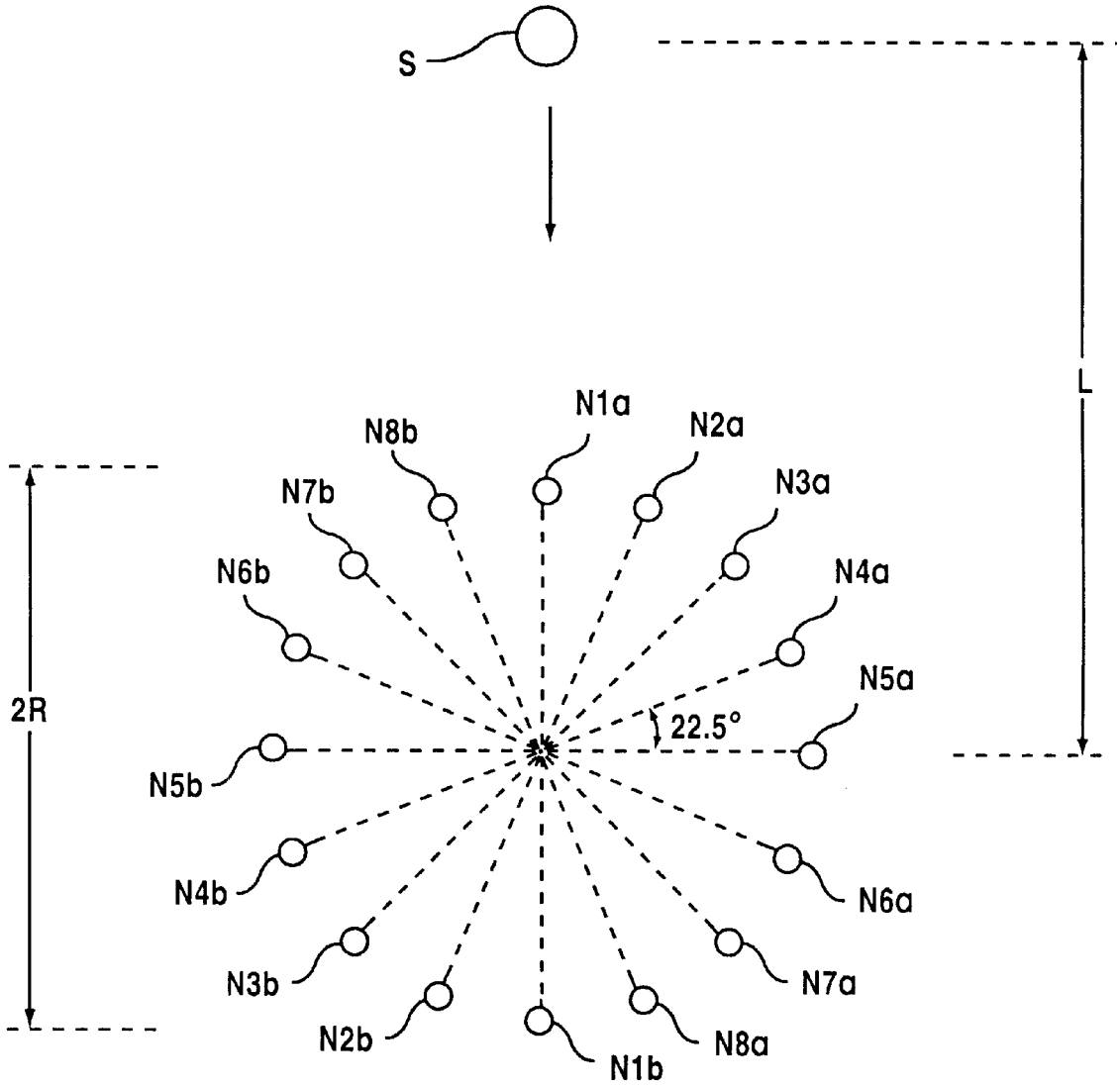
FIG. 6 is a diagram showing a structure of a microphone pair according to a third embodiment of the present invention.

FIG. 6 is a diagram showing a structure of a microphone pair according to a third embodiment. In the present embodiment, there will be shown an example of a microphone array in which two pairs of microphones orthogonal to each other form a set which is arranged at a crossing angle of 45 degrees or less.

According to the present embodiment, a direction of a sound source and a distance to the sound source are detected based on the microphone array in which 16 microphones are arranged on a concentric circle at an angle of 22.5 degrees as shown in FIG. 6.

More specifically, microphones N1*a* and N1*b* form a microphone pair N1, microphones N2*a* and N2*b* form a microphone pair N2, microphones N3*a* and N3*b* form a microphone pair N3, microphones N4*a* and N4*b* form a microphone pair N4, microphones N5*a* and N5*b* form a microphone pair N5, microphones N6*a* and N6*b* form a microphone pair N6, microphones N7*a* and N7*b* form a microphone pair N7, and microphones N8*a* and N8*b* form a microphone pair N8.

Referring to the set of microphones, the microphone pair N1 and the microphone pair N5 orthogonal thereto form microphone sets N1 and N5, the microphone pair N2 and the microphone pair N6 orthogonal thereto form microphone sets N2 and N6, the microphone pair N3 and the microphone pair N7 orthogonal thereto form microphone sets N3 and N7, and the microphone pair N4 and the microphone pair N8 orthogonal thereto form microphone sets N4 and N8.

The microphone sets N2 and N6 are arranged on a concentric circle at an angle of 22.5 degrees with respect to the microphone sets N1 and N5, the microphone sets N3 and N7 are arranged at an angle of 22.5 degrees with respect to the microphone sets N2 and N6, and the microphone sets N4 and N8 are arranged at an angle of 22.5 degrees with respect to the microphone sets N3 and N7. Accordingly, a crossing angle of the microphone pairs is 22.5 degrees in the present embodiment.

It is assumed that a position of a sound source S and that of the microphone array have a relationship shown in FIG. 6. More specifically, it is assumed that the position of the sound source S is set on an extension line of the microphone pair N1 on the same plane as the microphone array.

In the case where the sound source S is set in such a position, the direction of the sound source can be detected by the microphone pair N5 having the smallest difference output.

A method for detecting the distance to the sound source will be described below.

A sound volume is inversely proportional to the distance from the sound source. Therefore, if a space between the microphone pairs is represented by 2R (that is, a radius of the microphone array is represented by R), and a distance from a central position of the microphone array to the sound source S is represented by L, a ratio of sound pressure outputs detected by the microphone pair N1 orthogonal to the microphone pair N5 has the following relationship, wherein a sound pressure output of the microphone N1*a* is represented by N1*a*OUT and that of the microphone N1*b* is represented by N1*b*OUT.

$$N1aOUT/N1bOUT=(L+R)/(L-R)$$

the distance L from the central position of the microphone array to the sound source S can be obtained by the following equation.

$$L=(N1aOUT+N1bOUT)R/(N1aOUT-N1bOUT)$$

Figure 7:
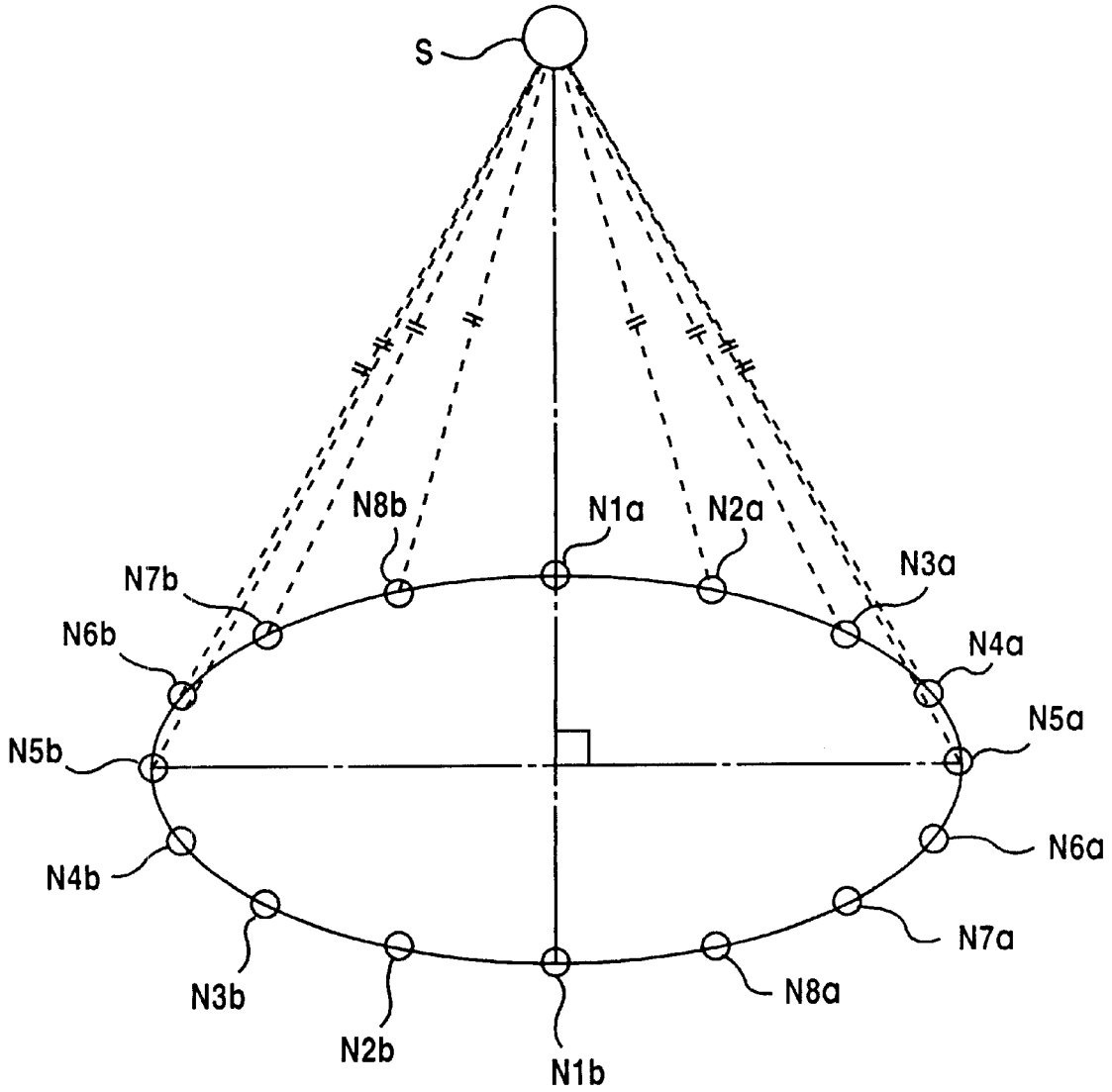
FIG. 7 is a diagram showing sensitivity adjustment of the microphones according to the present invention.

A non-directional microphone having a constant sensitivity to a direction of 360 degrees is used for the microphone array. By using a method shown in FIG. 7, the sensitivity of the microphone is adjusted.

The sound source S is provided on a central axis of the microphone array in such a manner that a distance from the sound source S to each microphone is constant. Thus, the sensitivity of each microphone is adjusted such that an output thereof is identical.

Figure 8:
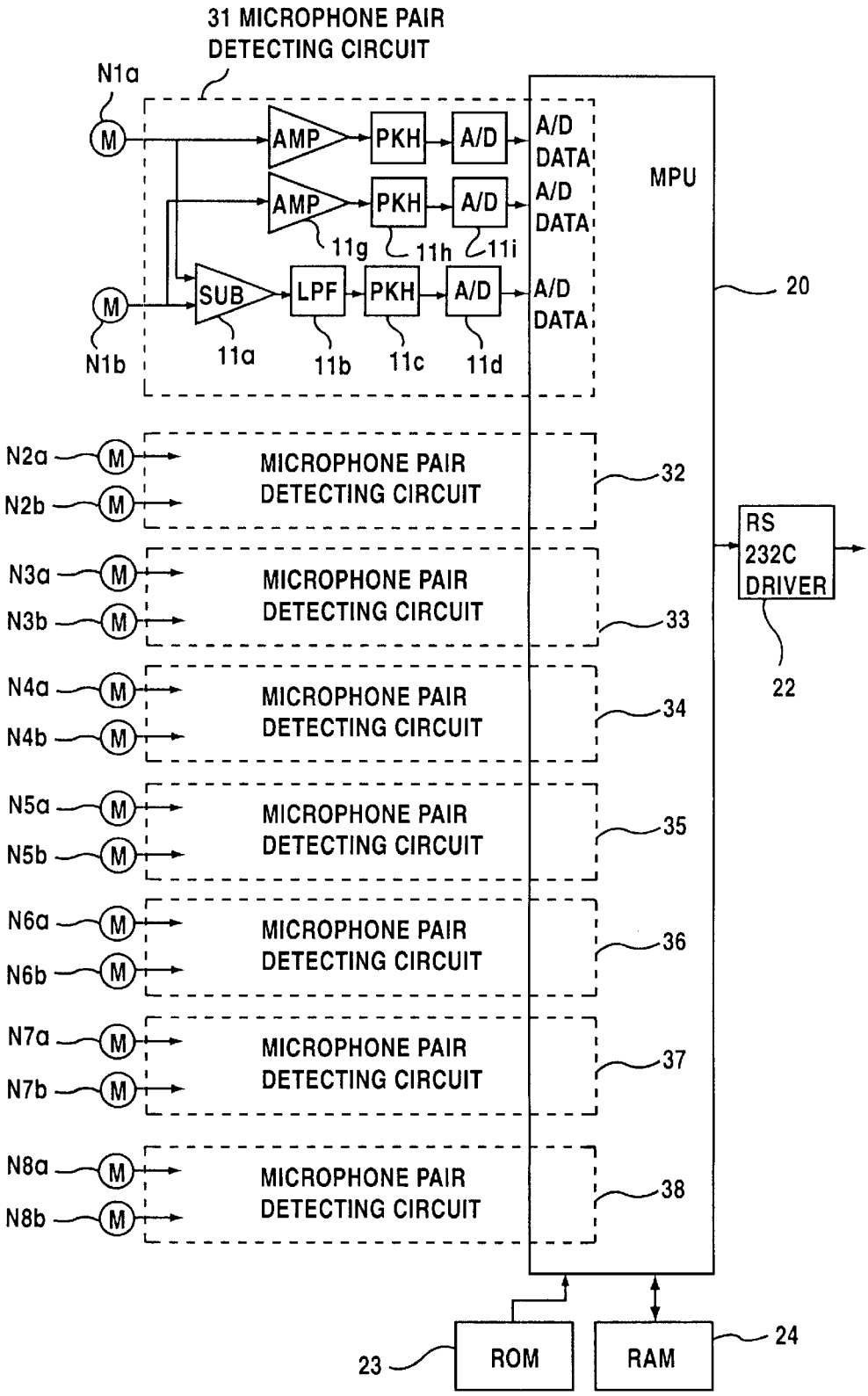
FIG. 8 is a block diagram showing a signal processing circuit according to the third embodiment of the present invention.

FIG. 8 is a block diagram showing a signal processing circuit. A signal processing will be described below with reference to the block diagram.

In FIG. 8, 31 to 38 denote microphone pair detecting circuits corresponding to the microphone pairs N1 to N8, respectively. Since each microphone pair detecting circuit is identical, only an internal portion of the microphone pair detecting circuit 31 is shown.

Data output from the microphone pair detecting circuits 31 to 38 are input to a MPU 20 and are output from the MPU 20 through a RS232C driver 22 in the same manner as in the circuit shown in FIG. 4. The MPU 20 is provided with a ROM 23 and a RAM 24.

Since the microphone pair detecting circuits 31 to 38 have the same function, the microphone pair detecting circuit 31 will be described as an example.

An output of the microphone pair N1, that is, an output of each of microphones N1*a* and N1*b* is input to an amplifier 11*g* indicated at AMP and is amplified, and is input to a subtraction circuit 11*a* indicated at SUB. The subtraction circuit 11*a* is formed by using an operational amplifier and the like according to the prior art.

An output of the subtraction circuit 11*a* is input to a low-pass filter 11*b* having a specific cut-off frequency F which is indicated at LPF.

As described above, the cut-off frequency F of the low-pass filter 11*b* and a sound velocity v and a space D (=2R) of the microphone pair have a relationship of F=V/2D. If a sound having a higher frequency than the cut-off frequency F arrives, an accurate direction of a sound source cannot be detected. Therefore, a frequency component which is higher than the cut-off frequency F is cut by means of the low-pass filter 11*b*.

An output of the low-pass filter 11*b* is held at a maximum value by a peak hold circuit 11*c* indicated at PKH. The held maximum value is converted into digital subtraction data by an analog/digital converter 11*d* indicated at A/D and is input to the MPU 20.

Each output of the amplifier 11*g* is held at a maximum value by a peak hold circuit 11*h* indicated at PKH. The held maximum value is converted into digital data by an analog/digital converter 11*i* indicated at A/D, and is input to the MPU 20.

The MPU 20 compares all the subtraction data of the microphone pairs N1 to N8, and selects the microphone pair having the minimum subtraction data to be stored in the RAM 24. Consequently, a direction of the sound source S is detected.

Next, any of the microphone pairs N1 to N8 which is orthogonal to the microphone pair having the minimum subtraction data is selected. Output data of the selected microphone pair is stored in the RAM.24. Based on the output data of the microphone pair, a distance L from a central position of the microphone array to the sound source S is calculated by the above-mentioned equation.

Such an operation program is stored in the ROM 23. The distance L is calculated in accordance with the stored program.

The MPU 20 sends data on the detected direction of the sound source S and data on the distance to a back processor such as a personal computer through the RS232C driver 22.

Thus, the direction of the sound source and the distance to the sound source can be detected by using a microphone array in which cross-shaped microphone sets having two microphone pairs orthogonal to each other are arranged on a concentric circle at an angle of 22.5 degrees.

While four sets of microphones are arranged on the concentric circle and a crossing angle of the microphone pairs is 22.5 degrees in the present embodiment, the microphone sets may be arranged at a crossing angle of 45 degrees or less. More specifically, if the condition that the crossing angle is 45 or less is met, a plurality of microphone sets may be arranged on the concentric circle at regular intervals. For example, two sets of microphones may be arranged at a crossing angle of 45 degrees, three sets of microphones may be arranged at a crossing angle of 30 degrees, or five sets of microphones may be arranged at a crossing angle of 18 degrees.

While only one microphone array has been used in the above description, two microphone arrays capable of detecting the direction of the sound source S can used to calculate the direction of the sound source S and the distance to the sound source S, which will be described below in a fourth embodiment.

[Fourth Embodiment]

Figure 9:
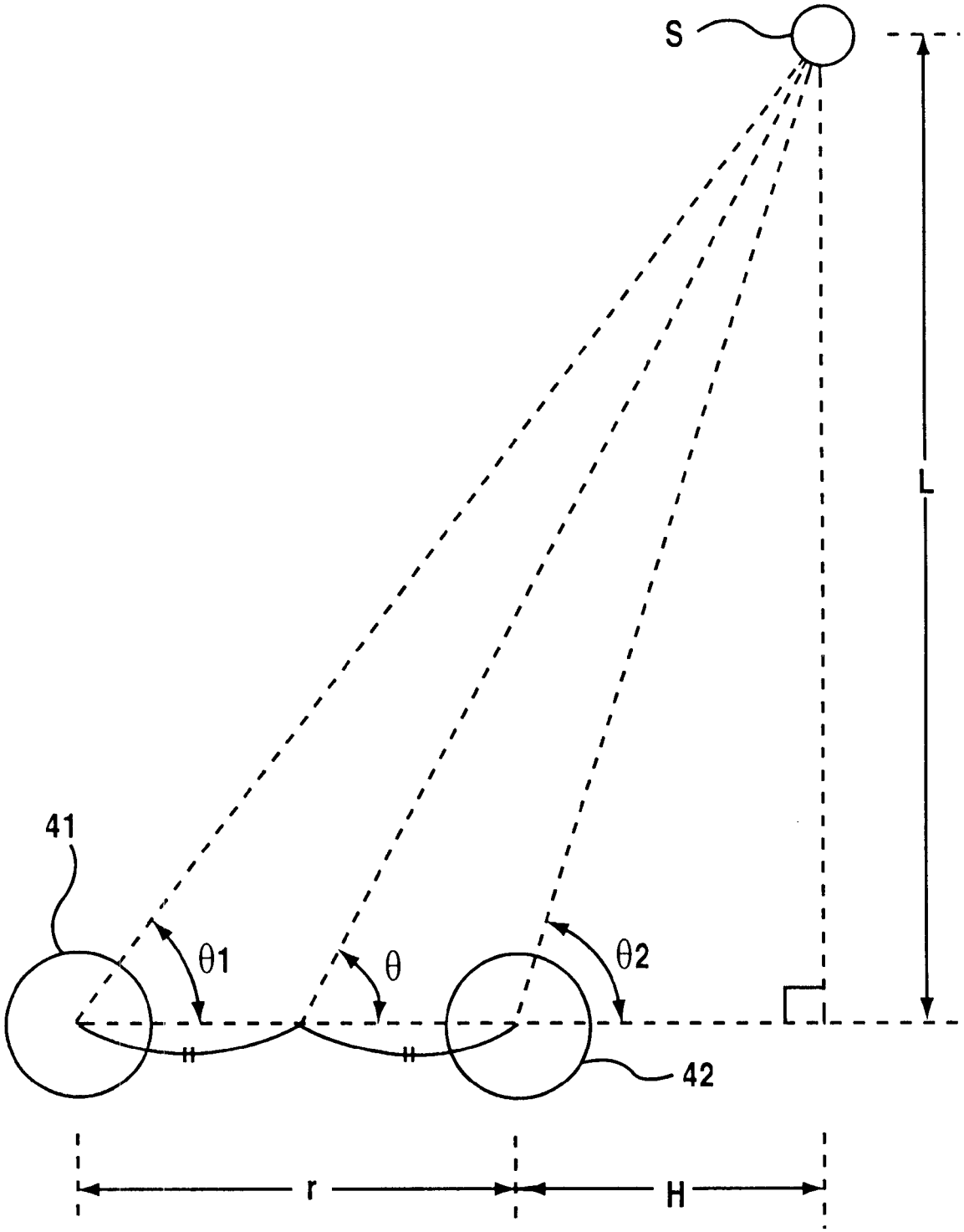
FIG. 9 is a diagram showing a structure of a microphone pair according to a fourth embodiment of the present invention.

FIG. 9 is a diagram showing a structure of a microphone pair according to a fourth embodiment. In the present embodiment, two microphone arrays are used as an example of arrangement.

In the present embodiment, two microphone arrays 41 and 42 are arranged apart from each other by a distance r. It is possible to use the microphone array shown in FIG. 3A and the microphone array shown in the [first example] or [second example] of FIGS. 5A and 5B. The microphone array shown in FIG. 6 may be used.

As shown in FIG. 9, a distance between two microphone arrays 41 and 42 is represented by r, a distance from microphone array faces formed by the microphone arrays 41 and 42 to a sound source S is represented by L, a distance from the microphone array 42 to a central position of the microphone array face is represented by H, and a direction of the sound source S detected by the microphone array 41 and that of the sound source S detected by the microphone array 42 are represented by θ1 and θ2. Consequently, the following equations are obtained.

$$L/(r+H)=\tan\theta 1$$

$$L/H=\tan\theta 2$$

Consequently, the distance L from the microphone array face to the sound source S can be calculated by the following equation.

$$L=r(\tan\theta 1/(1-\tan\theta 1/\tan\theta 2))$$

The distance H from the microphone array 42 to the central position of the microphone array face can be calculated by the following equation.

$$H=r(\tan\theta 1/(\tan\theta 2-\tan\theta 1))$$

The direction of the sound source S can be calculated by the following equation.

$$\tan\theta=1/(r/2L+1/\tan\theta 2)$$

The distance r between the microphone arrays 41 and 42 which has previously been stored is used. The distance L or H which is longer is selected as the distance from the microphone array to the sound source S.

Figure 10:
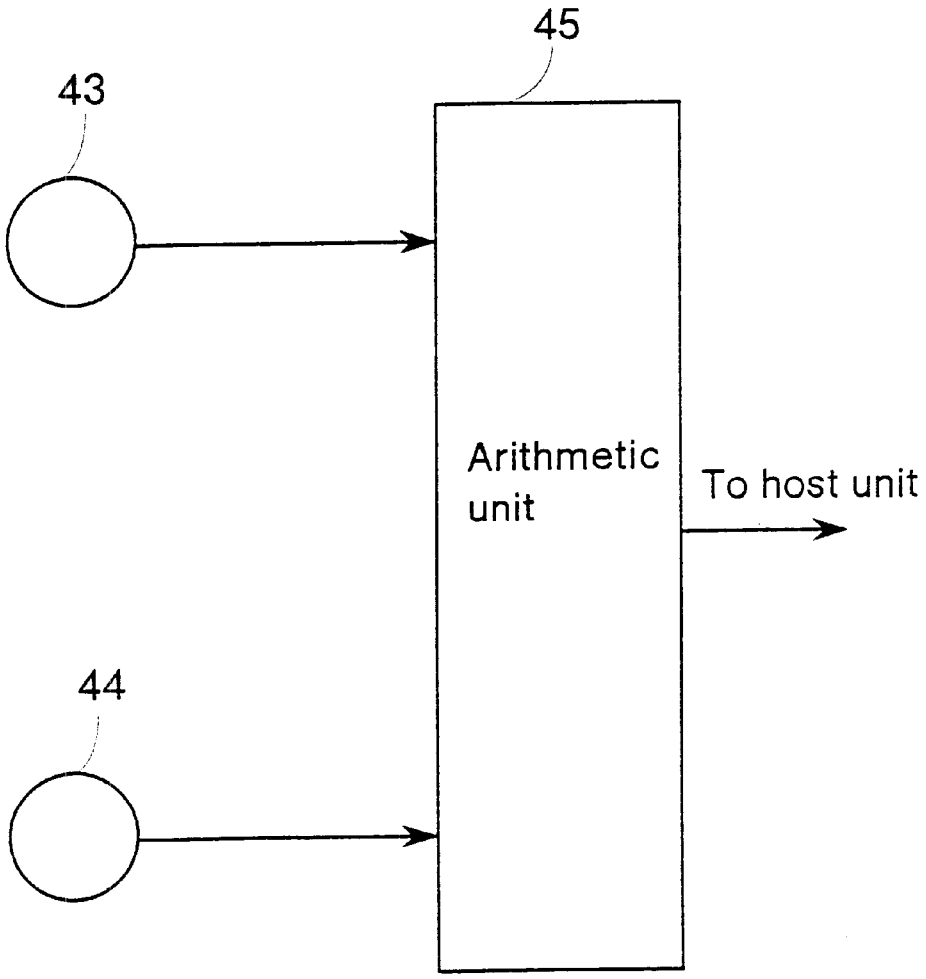
FIG. 10 is a diagram showing a circuit structure using two microphone arrays according to the present invention.

FIG. 10 is a diagram showing a circuit structure in which two microphone arrays are used. In FIG. 10, 43 and 44 denote sound source direction discriminators, each including a microphone array, a microphone pair detecting circuit and a MPU, and 45 denotes an arithmetic unit.

The circuit shown in FIG. 4 can be used as the sound source direction discriminators 43 and 44. The sound source direction discriminators 43 and 44 detect direction data θ1 and θ2 of the sound source S from an output of the microphone array, and output the same data to the arithmetic unit 45.

In the arithmetic unit 45, the distance L from the microphone array face to the sound source S or the distance H from the microphone array to the central position of the microphone array face and the direction θ of the sound source are calculated based on the direction data θ1 and θ2 of the sound source S and the distance r between two microphone arrays which have previously been stored. The data is output to a back processor (host unit) such as a personal computer.

Thus, the direction of the sound source and the distance to the sound source can be detected by using two microphone arrays.

A technique for detecting the direction of the sound source and the distance to the sound source can be utilized for software for producing a communication between a personal computer and a sounder (talker) positioned before the personal computer, for example. More specifically, the technique can be utilized for various kinds of communication software in which men or animals such as birds are displayed on a screen and they are turned in a direction of a sound source generated by the sounder.

As is apparent from the above description, the present invention produces the effect that a direction of a sound source can be detected with a small and simple structure and an object sound can be extracted with a high S/N ratio.

Although the present invention has fully been described by way of example with reference to the accompanying drawings, it is to be understood that various changes and modifications will be apparent to those skilled in the art. Therefore, unless otherwise such changes and modifications depart from the scope of the invention, should be construed as being included therein.

What is claimed is:

1. A microphone system comprising:

a plurality of microphone pairs, each pair having two microphones arranged apart from each other at a predetermined space at a crossing angle of 60 degrees or less;

a plurality of first calculating means for calculating a difference signal of outputs of each microphone pair;

a plurality of second calculating means for calculating a sum signal of outputs of each microphone pair;

means for detecting, as sound source direction information, a minimum value output from each output of the first calculating means; and means for selecting a sum signal of the microphone pair corresponding to the minimum value output and outputting the selected sum signal as sound information.

2. The microphone system according to claim 1, wherein a sum signal corresponding to a second smallest difference signal is also selected and output in addition to the sum signal corresponding to the minimum value of the difference signal.

3. The microphone system according to claim 1, wherein a plurality of microphone pairs are arranged on a concentric circle.

4. The microphone system according to claim 1, further comprising a low-pass filter for filtering the difference signal output from the first calculating means at a cut-off frequency F represented by V/2D=F between a sound velocity V and the space D.

5. A microphone system comprising:

a microphone array in which microphone sets are arranged at a crossing angle of 45 degrees or less, each microphone set including a first microphone pair having two microphones arranged apart from each other at a predetermined space and a second microphone pair orthogonal to the first microphone pair;

a plurality of first calculating means for calculating a difference signal of outputs of each microphone pair;

means for detecting, as a direction of a sound source, a minimum value output from each output of the first calculating means;

second calculating means for calculating a ratio of output voltages of a microphone pair orthogonal to a microphone pair corresponding to the minimum value output; and means for calculating a distance from the microphone array to a sound source based on the ratio of the output voltages which is calculated by the second calculating means.

6. A microphone system comprising a plurality of sound source direction discriminators including a plurality of microphone pairs, each pair having two microphones arranged apart from each other at a predetermined space at a crossing angle of 60 degrees or less, a plurality of calculating means for calculating a difference signal of outputs of each microphone pair, and means for detecting, as a direction of a sound source, a minimum value output from each output of the calculating means, wherein a crossing point of the directions of the sound source which are obtained by the sound source direction discriminators is calculated, thereby detecting a position of the sound source.

7. The microphone system according to any of claims 1 to 6, wherein the microphone is a non-directional microphone.

8. The microphone system according to claim 7, wherein the sound source is provided on a central axis of a microphone array, thereby adjusting a sensitivity of each microphone pair.

* * * * *